US011287118B2

(12) United States Patent
Xu

(10) Patent No.: US 11,287,118 B2
(45) Date of Patent: Mar. 29, 2022

(54) DYNAMIC LIGHTING DEVICE

(71) Applicant: POWER BEAUTY INDUSTRIAL CO., LTD., DongGuan (CN)

(72) Inventor: Yiqun Xu, DongGuan (CN)

(73) Assignee: POWER BEAUTY INDUSTRIAL CO., LTD., Dongguan (CN)

( * ) Notice: Subject to any disclaimer, the term of this patent is extended or adjusted under 35 U.S.C. 154(b) by 0 days.

(21) Appl. No.: 17/248,067

(22) Filed: Jan. 7, 2021

(65) Prior Publication Data

US 2022/0034494 A1 Feb. 3, 2022

(51) Int. Cl.

| | |
|---|---|
| ***F21V 21/28*** | (2006.01) |
| ***F21S 9/03*** | (2006.01) |
| ***F21V 21/32*** | (2006.01) |
| ***F21V 21/08*** | (2006.01) |

(52) U.S. Cl.

CPC ..... *F21V 21/28* (2013.01); *F21S 9/037* (2013.01); *F21V 21/0824* (2013.01); *F21V 21/32* (2013.01)

(58) Field of Classification Search

CPC ..... F21V 21/28; F21V 21/0824; F21V 21/32; F21V 21/14; F21V 21/108; F21V 14/02; F21V 14/025; F21S 9/037; Y10S 362/806

USPC ..... 362/419

See application file for complete search history.

(56) References Cited

U.S. PATENT DOCUMENTS

2013/0322083 A1* 12/2013 Toaspern ..... F21S 6/006 362/249.05

2016/0074759 A1* 3/2016 Kelly ..... A63H 1/24 446/242

FOREIGN PATENT DOCUMENTS

CN 107477455 * 12/2017

CN 108826104 * 11/2018

* cited by examiner

*Primary Examiner* — Lau K Tso

(74) *Attorney, Agent, or Firm* — Michael X. Ye; Rimon Law

(57) ABSTRACT

The present invention relates to a dynamic lighting device, including at least two lamps and a base. Each of the at least two lamps is connected to a respective paired flexible stalk configured to rotate in a circumferential direction of the base. When the flexible stalks rotate in the circumferential direction of the base, due to dynamic bending deformation of the flexible stalks, the at least two lamps have random movement in an upright direction and the at least two lamps have circumferential random wiggles against a joint defined between the flexible stalks and the base as a pivotal point.

2 Claims, 4 Drawing Sheets

DYNAMIC LIGHTING DEVICE

CROSS-REFERENCE TO RELATED APPLICATIONS

This application claims the benefit of the Chinese Patent Applications No. CN202010804516.7 filed on Aug. 11, 2020, No. CN 202021525136.1 filed on Jul. 28, 2020, and No. CN 202021664133.6 filed on Aug. 11, 2020, which are hereby incorporated by reference as if fully set forth herein.

BACKGROUND OF THE INVENTION

1. Technical Field

The present invention relates to a lighting device configured to be dynamic or generate a dynamic lighting effect, and more particularly to lighting device that provides a dynamic lighting effect that simulates the appearance of a small swarm of flying fireflies, wherein the dynamic lighting device may be powered by solar energy.

2. Description of Related Art

Dynamic lighting devices for decorative purposes are useful in adding romantic vibes by, for example, simulating fireflies flying at nighttime to give the twinkle. Firefly colored lamps arise because fireflies are known to be fairies of light in the nature. However, in view that it is difficult to artificially breed fireflies for decorative use, there are lighting devices designed to provide visual effects simulating flying fireflies on the market.

CN211059977U discloses an air-driven firefly light, whose boom has one end fixed to an immovable object and an opposite end connected to a hanging rope. The hanging rope has one end connected to the boom and an opposite end connected to a balance rod. The balance rod has one end provided with at least one LED lamp and an opposite end provided with a weight box. The balance rod has a joint connecting it to the lower end of the hanging rope. The balance rod is maintained at an angled balance against the joint due to the gravity, so that when affected by wind, the balance rod wiggles about the lower end of the hanging rope. The weight box includes a battery and a photoresistor connected to a controller IC while the LED lamp is wired to the battery. In darkness, the light provides a decorative lighting effect resembling fireflies flying up and down with twinkles. Nevertheless, the known firefly light cannot provide the intended flying-firefly visual effect without blowing wind, making its decorative performance less reliable.

SUMMARY OF THE INVENTION

The present invention provides dynamic lighting device, comprising at least two lamps and a base, being characterized in that each of the at least two lamps is connected to a respective paired flexible stalk configured to be able to rotate with respect to the base, so that when the flexible stalks rotate with respect to the base, due to dynamic bending deformation of the flexible stalks, the at least two lamps have random movement in an upright direction while performing random wiggles against a pivotal point that is a joint between the flexible stalks and the base.

According to a preferred mode, the present invention further provides a dynamic lighting device, comprising at least two lamps and a base, being characterized in that each of the at least two lamps is connected to one end of a respective paired flexible stalk, while opposite ends of the flexible stalks are rotatably retained by the base together, so that each of the at least two lamps can perform circumferential movements along circumferences of dynamically changing radiuses of the lamps with the corresponding flexible stalks rotating about the base but not moving in their respective axial directions. The flexible stalks when rotated, due to the dynamically changing resultant force of the combination of the dynamic centrifugal force, the gravity of the lamps and their own gravity, can at least make the lamps perform irregular wiggles in the radial direction of the lighting device in response to the radial horizontal component. That is, the radial displacements of the lamps with respect to the pivotal point are dynamically changing. However, due to the support from the flexible stalks, the radial displacements changes of the lamps are much smaller than their circumferential displacements changes. When the lamps illuminate, at least the irregular small wiggles of the lamps in the radial direction of the lighting device form a dynamically changing ambience effect with the help of merely a little hardware. In an embodiment where plural flexible stalks are grouped into bundles with different lengths and rotatably retained by the same rotating member, the resulting ambience effect is further more dynamic and vivid, yet the lighting device is easy to wire and store.

According to a preferred mode, the present invention further provides a dynamic lighting device, comprising at least two lamps and a base, being characterized in that each of the at least two lamps is connected to one end of a respective paired flexible stalk, and opposite ends of the flexible stalks are rotatably connected to the base, so that as the two flexible stalks are retained by and rotate with respect to the base, at least two projected images of the at least two lamps in an upright direction do not fully coincide with each other, and the at least two projected images have circumferential movement components defined against a pivotal point that is a joint between the flexible stalks and the base. When rotating with respect to the base, the flexible stalks are subject to the gravity of the lamps, their own gravity and the centrifugal force, and consequently perform dynamic bending deformations and random movements. Specifically, the random movements at least involve two aspects. Firstly, the flexible stalk rotates around the circumference of the base, thereby making the lamp perform circumferential wiggles (or sways) against a pivotal point that is actually the joint between the flexible stalk and the base. Secondly, due to the resultant force and the dynamic deformation of the flexible stalk, the lamp moves randomly in the upright direction (bouncing or somehow like floating). Since the flexible stalks are retained in the upright direction, the displacements of the lamps in the upright direction are much smaller than their circumferential displacements. When the lamps illuminate, at least the irregular small wiggles of the lamps in the radial direction of the lighting device can form dynamically changing ambience effect with the help of merely a little hardware. In an embodiment where plural flexible stalks are grouped into bundles that are retained by the same rotating member with the lamps arranged at different altitudes, the resulting ambience effect is dynamic in more dimensions, yet the lighting device is easy to wire and store.

According to a preferred mode, the present invention further provides a lighting device providing a dynamic lighting effect, comprising at least one lamp, the lighting device being characterized in that the lamp is connected to one end of a flexible stalk, and the flexible stalk has an opposite end such retained that when the flexible stalk rotates, a projected image of the lamp in an upright direction does not fully coincide with a projected image of the flexible stalk in the upright direction for at least a period of time, so the at least one lamp exhibits circumferential wiggles. The flexible stalk when rotated, due to the changing resultant force coming from the combination of the dynamic centrifugal force, the gravity of the lamp and its own, can at least have the lamp wiggling irregularly along the circumference of the light in response to the circumferential horizontal component. In addition, when the lamp illuminates, at least the irregular wiggles of the lamp along the circumference of the light can provide a dynamically changing ambiance effect with the help of a little hardware. In an embodiment where plural flexible stalks are bundled together and rotatably retained by the same rotating member, the resulting ambience effect is even more dynamic and vivid, yet the lighting device is easy to wire and store.

According to a preferred mode, the flexible stalks are connected to the lamps that are point light sources in a manner that the flexible stalks are opaque. Preferably, the flexible stalks are such formed that they are opaque and non-reflective. Preferably, the base is such formed that it is opaque and non-reflective. In this way, when the lamps illuminate at night, their movements form tracks of point light sources, thereby preventing appearance of line light that could otherwise be caused by illuminating or reflective flexible stalks. Thus irregular movement of line light sources will not occur.

According to a preferred mode, the at least two lamps the at least two lamps are point light sources that are separated from the joint by different lateral distances and/or upright distances.

According to a preferred mode, the present invention further provides a dynamic lighting device, comprising a base and a lamp, being characterized in that the lamp is connected to one end of a flexible stalk, wherein the flexible stalk is connected to a rotating shaft that is installed inside the base in a manner that the flexible stalk juts out of at least one surface of the base and the rotating shaft serves to wiggle the flexible stalk, while the rotating shaft is connected to a rotating mechanism in a manner that the flexible stalk is restricted to wiggle in a predetermined range.

According to a preferred mode, the rotating mechanism comprises a rotating arm and a driving arm, in which the driving arm has a sliding guide configured to form a sliding pair with a sliding block provided on the rotating arm; and the driving arm has a through hole configured to fittingly receive the rotating shaft.

According to a preferred mode, the sliding guide has a length such sized that the rotating shaft is restricted to rotate in an acute-angle range.

According to a preferred mode, the present invention further provides a solar energy lighting device comprising at least two lamps and a base, the at least two lamps being connected to one ends of their respective flexible stalk, wherein the base is atop provided with a solar panel and the solar panel is electrically connected to a power storage assembly through a mainboard. The selection of solar energy is based on some reasons. Firstly, the lighting device of the present invention is relatively less power-consuming and the lighting device only has to continuously work for a few hours, such as 3 or 4 hours, so the use of solar energy eliminates the hassle of external wiring. Secondly, the lighting device is designed to be used mostly in outdoor environments where solar energy is highly availably and accessible, and the use of solar energy makes the disclosed lighting device meet the requirements of environmental protection and energy preservation. Thirdly, for giving an adequate amount of the decorative effect in outdoor environments, it is desirable to have multiple lighting devices used together. In this case, with the use of solar energy, these lighting devices can just be left outdoors without the hassle to move them into houses for battery charging, which saves human labor and enables the lighting device to heighten atmosphere with natural resources at night.

In the modes described previously, when rotating with respect to the base, the gravity of both the lamps and the flexible stalks and the resilience of the flexible stalk change randomly with the rotation of the stalks, thereby making the stalks carrying the lamps move randomly. That is, by merely using flexible stalks of different lengths, the at least two lamps can be subject to different centrifugal forces under the same rotation speed.

In the modes described previously, not only do the flexible stalk have different lengths, but also the lamps have different weights. Herein, the different lengths and the different weights can both cause different centrifugal forces. Herein, flexible stalks made of different materials can show flexibility and resilience differently with the same length. With the foregoing measures, different combination of centrifugal forces and flexibility or resilience can be achieved, so as to present ever changing random movements of the lamps by making the flexible stalks rotate at a uniform speed. After the rotation of flexible stalk with respect to the base stops, the random movements will continue due to the resultant force of the gravity and the resilience for a while before the lamps gradually come to still.

In the modes described previously, movements of the base, such as rotation or a combination of different kinds of motions, may also be used to lead to movements of the lamps. Briefly, interaction among the weight of the lamps, the weight and resilience of the flexible stalks and the movement features could bring about significantly different effects.

In the modes described previously, the lamps are held in place by and powered through their respective flexible stalks. Therein, the flexible stalks are connected to the movement mechanism through a connecting portion built in the base, so that the flexible stalks carrying the lamps can be driven to rotate. Preferably, the pivotal point of the flexible stalk(s) is defined by the flexible stalk(s) and the base, so as to enable circumferential rotation, circumferential wiggles and/or circumferential and axial sways. Herein, due to the resultant force of the gravity and the resilient restoration, the plural lamps perform irregular and diverse movements in the circumferential direction and in the upright direction, so as to give a dynamic visual effect in all observation directions around the lighting device. Thereby, in the night, when the plural lamps illuminate and the flexible stalks rotate with respect to the base, a simulated scene of a swarm fireflies flying in the night sky that is true to nature can be created to reproduce the tracks of swirling fireflies (with circumferential wiggles and vertical jerks). In practice, several lighting devices such built can be used together to create a simulated scene of a swarm fireflies flying in the night sky.

100*a*: flexible stalk; 300*b*-2: driving arm; 100*b*: lamp; 300*b*-3: rotary actuator; 200: base; 300*b*-2*a*: through hole; 500: ground insert; 300*b*-2*b*: sliding guide; 200*a*: watertight cap; 400*a*: solar panel; 300*a*: rotating shaft; 400*b*: power storage assembly; 300*b*: rotating mechanism; 400*c*: mainboard; 300*b*-1: rotating arm; 400*d*: control switch

DETAILED DESCRIPTION OF THE INVENTION

The following description, in conjunction with the accompanying drawings FIGS. 1 through 6 and preferred embodiments, is set forth as below to illustrate the implement, structure, features and effects of the subject matter of the present invention.

Embodiment 1

Figure 1:
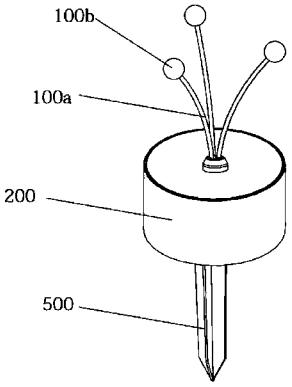
FIG. 1 depicts a preferred lighting device of the present invention.
Figure 4:
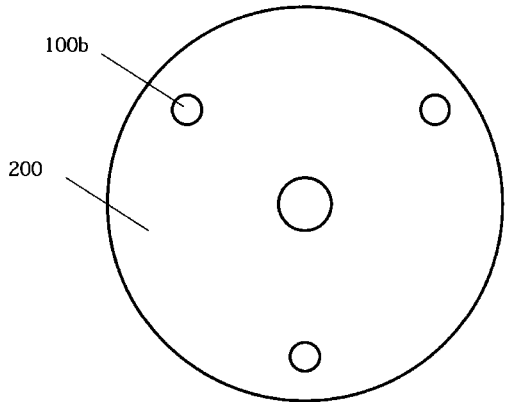
FIG. 4 is a schematic drawing showing projections of the lamps on the base in a first preferred mode.
Figure 5:
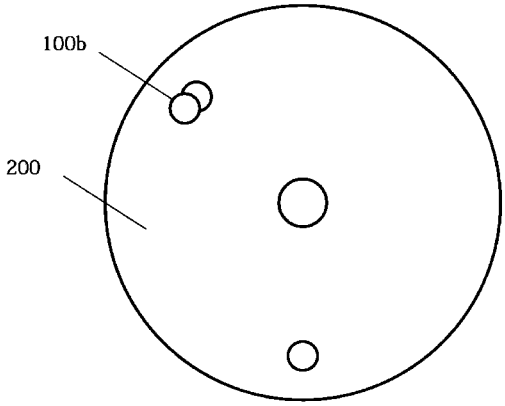
FIG. 5 is a schematic drawing showing projections of the lamps on the base in a second preferred mode.
Figure 6:
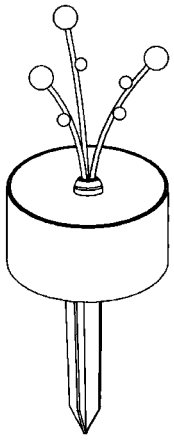
FIG. 6 depicts another preferred lighting device of the present invention.

The present embodiment provides a dynamic lighting device, and more particularly a decorative lighting device that has a lighting effect simulating flying fireflies. As shown in FIG. 1, the device comprises lamps 100*b* and base 200. As shown in FIG. 4 or FIG. 5, the lamps 100*b* have their projective images on the base 200 not fully coinciding with each other. The number of the lamps 100*b* is at least two. The lamps 100*b* are connected to their respective paired flexible stalks 100*a*. The flexible stalks 100*a* are configured to rotate with respect to the base 200. When each of the flexible stalks 100*a* rotates with respect to the base 200, due to the gravity of the connected lamp 100*b*, its own gravity and the centrifugal force it is subject to, the flexible stalk 100*a* undergoes dynamic bending deformation and performs random movements. Specifically, the random movements at least involve two aspects. Firstly, the flexible stalk 100*a* rotates around the circumference of the base 200, thereby making the lamp 100*b* perform circumferential wiggles (or sways) against a pivotal point that is actually the joint between the flexible stalk 100*a* and the base 200. Secondly, due to the resultant force and the dynamic deformation of the flexible stalk, the lamp 100*b* moves randomly in the upright direction (jerking or somehow like floating). Thus, when the light is used in darkness, each of the lamps 100*b* illuminates and moves like a flying firefly on the flexible stalk 100*a* with respect to the base 200, so as to provide a visual effect simulate a swarm of twinkling and flying fireflies.

Preferably, the lamps 100*b* may each be a point light source and the flexible stalks 100*a* are opaque. Preferably, the lamps 100*b* may be LEDs or the like. Preferably, each of the lamps 100*b* may be shaped like a butterfly, a dragonfly, a flower, or a bird. Preferably, each of the lamps 100*b* may emit light of a color of at least of red, orange, blue, green, yellow and purple. Preferably, different lamps 100*b* may emit light of different colors, so as to provide a more colorful and visually dynamic decorative lighting effect.

Preferably, the at least two lamps 100*b* are configured to work as point light sources that have different lateral distance and/or upright distance away from the joint. As shown in FIG. 1, the upright distance refers to a distance between the geometric center of the lamp 100*b* and the joint in the direction of the gravity. As shown in FIG. 4 or FIG. 5, the lateral distance refers to a distance between the geometric center of the lamp 100*b* and the joint in the direction of the horizontal. Consequently, the projective images of the lamps 100*b* on the base do not coincide with each other. With such configuration, the altitudes and tracks of the simulated flying fireflies are diverse, thereby further enhancing the vivid decorative performance.

Preferably, the flexible stalk 100*a* has a hollow structure for receiving and retaining a control line. The control line has its output end electrically connected to a mainboard 400*c* and has its input end electrically connected to the lamp 100*b*. In the present invention, the mainboard 400*c* is primarily used to control the lamp 100*b* among different working modes. For example, the mainboard 400*c* is configured to switch the lamp 100*b* among the following modes: 1. Constant lighting, for nighttime lighting; 2. Twinkling, resembling twinkling fireflies; and 3. Cyclic lighting, where the lamps 100*b* illuminate following a predetermined program, such as Lamp 1 on while Lamp 2 off, and Lamp 1 off while Lamp 2 on, for simulating a swarm of fireflies flying in the sky. The mainboard 400*c* may be an IC board, which is preprogrammed with the foregoing control modes.

Preferably, the mainboard may comprise a processor, a memory and/or a wireless module. The processor is connected to the memory and the wireless module. The lighting device may be equipped with a wireless remote control. The mainboard may receive instructions from the wireless remote control through the wireless module and accordingly to achieve at least one control of the rotating speed of the rotating mechanism and/or the working mode of the lamps. The wireless module may be one using the Bluetooth technology, the IR technology or the ZigBee technology. In addition, the mainboard, the processor and/or the wireless remote control in the present invention may be composed of any combination and connection of hardware. For example, the mainboard, the processor and/or the wireless remote control may be realized using an application-specific integrated circuit (ASIC), an FPGA, a general computer or any other hardware equivalents.

Preferably, the flexible stalk 100*a* may be a resilient steel wire, and the control line may be wound around and retained by the resilient steel wire. Alternatively, the control line may be arranged parallel to the resilient steel wire, and the two may be then held together by a flexible sleeve.

Preferably, the base 200 contains therein a rotating shaft 300*a*. The flexible stalk 100*a* juts out of at least one surface of the base 200. As shown in FIG. 1, the flexible stalk 100*a* extends out the upper surface of the base 200 along the axial direction of the base (or the upright direction). The flexible stalk 100*a* has one end fixed to the rotating shaft 300*a*. When the rotating shaft 300*a* rotates, the flexible stalk 100*a* drive the lamp 100*b* to move. Since the present invention is intended to simulate flying fireflies, it is desirable to limit the rotating range of the rotating shaft 300*a*, and inter the wiggling range of the flexible stalks 100*a* and the random movement range of the lamps 100*b*, to a certain angle but not 360°. The rotating shaft 300*a* is connected to the rotating mechanism 300*b*.

Figure 2:
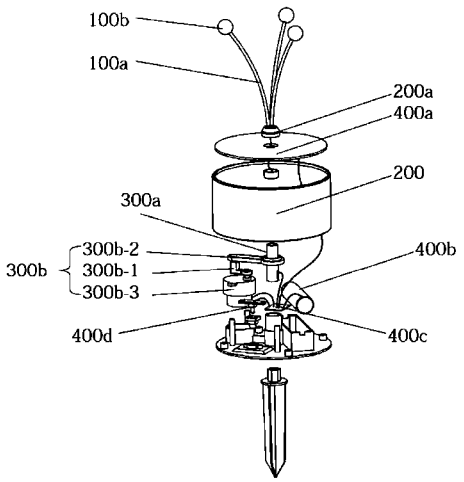
FIG. 2 is an exploded view of the preferred lighting device of the present invention.
Figure 3:
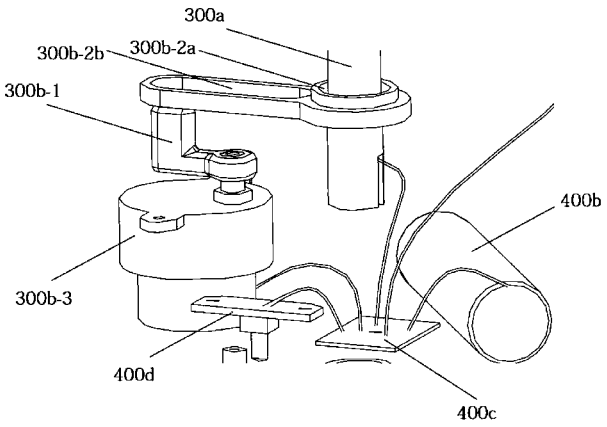
FIG. 3 is a partial, close-up view of FIG. 2.

As shown in FIGS. 2 and 3, the rotating mechanism 300*b* comprises a rotating arm 300*b*-1 and a driving arm 300*b*-2. The driving arm 300*b*-2 has a sliding guide 300*b*-2*b* that forms a sliding pair with a sliding block provide on the rotating arm 300*b*-1. The driving arm 300*b*-2 has a through hole 300*b*-2*a* for fittingly receiving the rotating shaft 300*a*. The rotating arm 300*b*-1 is fixed to the output shaft of a rotary actuator 300*b*-3 (such as an electric motor or a motor). When the electric motor operates, it drives the rotating arm to rotate, which in turn makes the sliding block moves along the sliding guide 300*b*-2*b*, so that the driving arm 300*b*-2 starts to move and drive the rotating shaft 300*a* to rotate.

Preferably, the sliding guide 300*b*-2*b* has a length that limit the rotating shaft 300*a* to rotate within a predetermined acute-angle range. The range for the rotating shaft 300*a* to rotate is preferably 0-45°. For example, every time the rotating shaft 300*a* rotates for 45°, the rotating shaft 300*a* starts to move reversely. People skilled in the art when determining the length of the sliding guide 300*b*-2*b* may refer to the conventional technical means for a mechanical four-link mechanism.

In addition, another preferred rotating mechanism 300*b* may comprise a step motor. The step motor directly (or through a reduction gear) drives the rotating shaft 300*a* to rotate. The step motor has a rotating angle of 0-45°. In this case, every time the step motor rotates for 45°, the step motor rotates reversely.

The present embodiment provides an optional power supply mechanism. Preferably, the base 200 is atop provided with a solar panel 400*a*. The solar panel 400*a* is electrically connected to power storage assembly 400*b* through the mainboard 400*c*. In daytime, the solar panel 400*a* converts solar energy into electric energy that is stored in the power storage assembly 400*b*. The power storage assembly 400*b* may be a rechargeable battery. Preferably, the power storage assembly 400*b* is electrically connected to the lamps 100*a* and the rotary actuator 300*b*-3 through a control switch 400*d*. The power storage assembly 400*b* uses the electric energy it sores to power the lamps 100*a* to illuminate and power the rotary actuator 300*b*-3 to rotate the rotating shaft. The foregoing circuit layouts can be all achieved using technical means well known in the art, and therefore people skilled in the art can easily determine the related technical indicators such as the conversion power of the solar panel and the capacity of the battery according to the desired time for simulation of flying fireflies. The control switch 400*d* is such installed on the base that it can be operated from outside.

Preferably, in the present embodiment, the light may be alternatively or additional charged using the traditional approach where a battery is charged by a 220 kv AC source, so that the light can be used in places without sunlight. In this case, the base is provided with a charge port, such as a USB port, as a backup power solution.

Preferably, the base 200 has a watertight cap 200*a* that is sealed to the base 200 for the flexible stalk(s) 100*b* to pass through. As shown in FIG. 1 and FIG. 2, the watertight cap 200*a* has a hollow structure and is peripherally formed with threads by which it is screwed and sealed to the base 200. The flexible stalk 100*b* is fixed behind the rotating shaft and passes through the hollow structure before jutting out of the base 200.

The present embodiment discloses a ground insert 500 as a means to holding the lighting device in place. As shown in FIGS. 1 and 2, the ground insert 500 has one end fixed to (for example, screwed to) the base 200, and has an opposite end shaped with a sharp point for easily insertion into the soil.

In addition, the lighting device may be made without having any holding parts. In this case, it is shaped to have a flat surface on which it can be placed on the ground stably.

Preferably, a lighting device that provides a dynamic decretive effect comprises at least one lamp 100*b*. The lamp 100*b* is connected to one end of a flexible stalk 100*a*. The flexible stalk 100*a* has its opposite end such retained that when the flexible stalk 100*a* is rotated, the projected image of the lamp 100*b* in the upright direction does not coincide with the projected image of the flexible stalk 100*a* in the upright direction for at least a predetermined period of time, thereby making the at least one lamp 100*b* perform circumferential wiggles. The flexible stalk 100*a* when rotated, due to the changing resultant force coming from the combination of the dynamic centrifugal force, the gravity of the lamp 100*a* and its own, can at least have the lamp 100*a* wiggling irregularly along the circumference of the light in response to the circumferential horizontal component. In addition, when the lamp 100*a* illuminates, at least the irregular wiggles of the lamp along the circumference of the light can provide a dynamically changing ambiance effect with the help of a little hardware. In an embodiment where plural flexible stalks 100*a* are bundled together and rotatably retained by the same rotating member, the resulting ambience effect is even more dynamic and vivid, yet the lighting device is easy to wire and store.

Preferably, the present embodiment discloses a dynamic lighting device comprising at least two lamps 100*b* and a base 200. Each of the at least two lamps 100*b* is connected to one end of their respective paired flexible stalk 100*a*. The flexible stalks 100*a* have their opposite ends jointly retained by the base 200 in a rotatable manner, so that when the flexible stalks 100*a* rotate with respect to the base without moving in their axial directions, the at least two lamps 100*b* can perform circumferential movements along the circumferences of their dynamically changing radiuses. The flexible stalks 100*a* when rotated, due to the dynamically changing resultant force of the combination of the dynamic centrifugal force, the gravity of the lamps 100*a* and their own gravity, can at least make the lamps 100*a* perform irregular wiggles in the radial direction of the lighting device in response to the radial horizontal component. That is, the radial displacements of the lamps 100*a* with respect to the pivotal point are dynamically changing. However, due to the support from the flexible stalks 100*a*, the radial displacements changes of the lamps 100*a* are much smaller than their circumferential displacements changes. When the lamps 100*a* illuminate, at least the irregular small wiggles of the lamps in the radial direction of the lighting device form a dynamically changing ambience effect with the help of merely a little hardware. In an embodiment where plural flexible stalks 100*a* are grouped into bundles with different lengths and rotatably retained by the same rotating member, the resulting ambience effect is further more dynamic and vivid, yet the lighting device is easy to wire and store.

Preferably, the present embodiment discloses a dynamic lighting device comprising at least two lamps 100*b* and a base 200. The at least two lamps 100*b* are connected to one end of their respective paired flexible stalks 100*a*. The flexible stalk 100*a* has its opposite end rotatably connected to the base 200, so that when the flexible stalk 100*a* is retained by the base and rotating with respect to the base, at least two projected images of the at least two lamps 100*b* on the base 200 in the upright direction do not fully coincide with each other, and the lamps 100*b* have circumferential movement components against their pivotal point, which is the joint between the flexible stalk 100*a* and the base 200. The flexible stalk 100*a* is configured to rotate with respect to the base 200. Since the flexible stalks 100*a* when rotating with respect to the base 200 are subject to the gravity of the lamps 100*b*, their own gravity, and the centrifugal force, the flexible stalks 100*a* perform dynamic bending deformation and move randomly. Specifically, the random movements at least involve two aspects. Firstly, the flexible stalk 100*a* roughly moves along the circumference of the base 200, thereby making the lamp 100*b* perform circumferential wiggles (or sways) against a pivotal point that is actually the joint between the flexible stalk 100*a* and the base 200. Secondly, due to the resultant force and the dynamic deformation of the flexible stalk, the lamp 100*b* moves randomly in the upright direction (jerking or somehow like floating). However, since the flexible stalks 100*a* are retained in the upright direction, the displacements of the lamps 100*a* in the upright direction are much smaller than their circumferential displacements. When the lamps 100*a* illuminate, at least the irregular small wiggles of the lamps in the radial direction of the lighting device can form dynamically changing ambience effect with the help of merely a little hardware. In an embodiment where plural flexible stalks 100*a* are grouped into bundles that are retained by the same rotating member with the lamps arranged at different altitudes, the resulting ambience effect is dynamic in more dimensions, yet the lighting device is easy to wire and store. Thus, when the light is used in darkness, each of the lamps 100*b* illuminates and moves like a flying firefly on the flexible stalk 100*a* with respect to the base 200, so as to provide a visual effect simulate a swarm of twinkling and flying fireflies.

In addition, the flexible stalk 100*a* carrying the lamp(s) may be fixed to the base and driven to move by any feasible means. For example, the flexible stalk 100*a* may be wound into the base so as to make the lamp(s) move in an irregular pattern. Alternatively, the flexible stalk may have its length changed during operation in other possible manners. Moreover, various approaches to having the base 200 or a part thereof rotate and in turn drive the flexible stalk to move are devisable and are within the scope of the present invention.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A dynamic lighting device, comprising at least two lamps and a base, being characterized in that each of the at least two lamps is connected to a respective paired flexible stalk configured to be able to rotate with respect to the base, so that when the flexible stalks rotate with respect to the base, due to dynamic bending deformation of the flexible stalks, the at least two lamps have random movement in an upright direction and the at least two lamps have random wiggles against a joint defined between the flexible stalks and the base as a pivotal point;

wherein the top surface of the base is provided with a solar panel, and the solar panel is electrically connected to a power storage assembly through a mainboard.

2. A dynamic lighting device, being characterized in that the device comprises at least two lamps and a base, the lamps have their projective images on the base not fully coinciding with each other, the lamps (100*b*) are connected to their respective paired flexible stalks, the flexible stalks are configured to rotate with respect to the base, when each of the flexible stalks rotates with respect to the base, due to the gravity of the connected lamp, its own gravity and the centrifugal force it is subject to, the flexible stalk undergoes dynamic bending deformation and performs random movements;

wherein the top surface of the base is provided with a solar panel, and the solar panel is electrically connected to a power storage assembly through a mainboard.

* * * * *